US012029964B2

(12) United States Patent
Klotz et al.

(10) Patent No.: US 12,029,964 B2
(45) Date of Patent: Jul. 9, 2024

(54) SPECIAL 21-POINT ELECTRONIC SCORE DEVICE FOR GAMES SUCH AS CORN HOLE

(71) Applicants: Andrew L Klotz, Noblesville, IN (US); Paul E Dytmire, Parker City, IN (US)

(72) Inventors: Andrew L Klotz, Noblesville, IN (US); Paul E Dytmire, Parker City, IN (US)

( * ) Notice: Subject to any disclaimer, the term of this patent is extended or adjusted under 35 U.S.C. 154(b) by 296 days.

(21) Appl. No.: 17/493,314

(22) Filed: Oct. 4, 2021

(65) Prior Publication Data

US 2023/0105254 A1 Apr. 6, 2023

(51) Int. Cl.

| | |
|---|---|
| ***A63B 69/00*** | (2006.01) |
| ***A63B 67/06*** | (2006.01) |
| ***A63B 71/06*** | (2006.01) |
| ***G07C 1/24*** | (2006.01) |

(52) U.S. Cl.

CPC ..... *A63B 71/0669* (2013.01); *A63B 67/06* (2013.01); *A63B 2071/0694* (2013.01)

(58) Field of Classification Search

CPC ..... A63B 71/0669; A63B 67/06; A63B 2071/0694; A63B 2102/02; A63B 2102/04; A63B 2102/16; A63B 2209/00; A63B 2210/50; A63B 2225/682; A63B 2225/685; A63B 2225/74; A63B 2243/0095

See application file for complete search history.

(56) References Cited

U.S. PATENT DOCUMENTS

| | | | | |
|---|---|---|---|---|
| 3,922,805 | A | 12/1975 | Krug | |
| 5,025,748 | A | 6/1991 | Pettis | |
| 6,725,107 | B2 | 4/2004 | MacPhearson | |
| 10,406,423 | B1 | 9/2019 | Clarke | |
| 11,389,712 | B2 * | 7/2022 | Butler, Jr. | A63B 71/0669 |
| 11,617,935 | B2 * | 4/2023 | Jones | A63B 71/0672 273/402 |
| 11,648,453 | B2 * | 5/2023 | Michael | A63B 67/06 273/372 |
| 2010/0050926 | A1 | 3/2010 | Volack et al. | |
| 2014/0091526 | A1 * | 4/2014 | Nally | A63B 63/08 273/402 |
| 2015/0182852 | A1 * | 7/2015 | Morgan | A63B 67/06 273/348.3 |
| 2015/0360114 | A1 | 12/2015 | Chung | |
| 2016/0121195 | A1 | 5/2016 | Brown | |

FOREIGN PATENT DOCUMENTS

| | | | |
|---|---|---|---|
| CN | 201744149 | U | 7/2010 |
| CN | 108992906 | A | 12/2018 |
| KR | 20060036309 | A | 4/2006 |

* cited by examiner

*Primary Examiner* — Toan N Pham

(74) *Attorney, Agent, or Firm* — Ritchison Law Offices PC; John D Ritchison

(57) ABSTRACT

A special 21-point electronic score device for games like Corn Hole. It is a portable, easy-to-see electronic scoreboard designed specifically for the popular backyard game of cornhole. It is made of durable materials with a fold-in base and includes 42 LEDs (21 on each side) stacked in the traditional score tower style that allows it to be used any time of day or night. It stands approximately fifty (50) inches high when in use and then can fold down to approximately thirty-six (36) inches for easy storage and portability. It has a handle for convenient carrying, a drink holder, and a compartment on top to hold a phone in place for video recording competitive games. The scoreboard can be used for any game played to 21 points.

18 Claims, 10 Drawing Sheets

42B
41
90
110
121R
31,30
122
G, F
135
40,45OS
42A
100
82B
121L
120
134
80
82T
40
72
71
45OS
128,87
132
139
131
130
89
86
45IS
70
84L
82B,88
31,30
125
133
135
G, F
184
88
90(beneath)
121R
31,30
139
139S
45OS, 40
84R
180
84L
87,128
121L
120
125
133
135
131
132
Between 121L,R
130
37

Sect. A-A

Sect. D-D

Sect. E-E

Sect. B-B X2

Fig. 6 C Sect. C-C

Figure 1B:
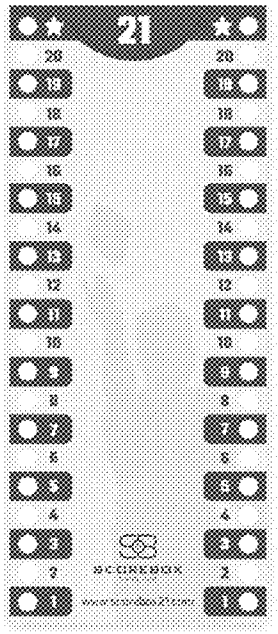

Mounting Boss
PCB- and Battery Mounting
Thickness and Size to suit/typical

Sample Circuitry for PCB

LED or Bulb socket – X4

Patent Appn.
US 2010/0050926

US Patent 3,922,805

US Patent 10,406,423

SPECIAL 21-POINT ELECTRONIC SCORE DEVICE FOR GAMES SUCH AS CORN HOLE

CROSS-REFERENCE TO RELATED APPLICATIONS

None.

FIELD OF INVENTION

This invention relates to a special 21-point electronic score device for games such as Corn Hole, horseshoes, table tennis, and others. The technical field is specifically related to a kind of portable LED ball match score display, belongs to technical field of sports instruments. The invention relates generally to outdoor games and accessories, and to a score-keeping device for a corn hole contest or game.

More particularly this relates to a portable, compact score indicator. The present invention relates to a portable scoreboard and structure, and more particularly, to a portable scoreboard and structure that can display the results of the game made in the indoor and outdoor by a simple switch or push-button operation and one that is convenient to carry. The present invention relates to scoring devices and more particularly to a portable, compact, retractable scoring device which may be expeditiously set-up at a sporting event.

FEDERALLY SPONSORED RESEARCH

None.

SEQUENCE LISTING OR PROGRAM

None.

BACKGROUND-FIELD OF INVENTION AND PRIOR ART

As far as known, there are no special 21-point electronic score device for games such as Corn Hole or the like. It is believed that this product is unique in its design and technologies.

Background

For many outdoor events, a game employing beanbags and plywood goals has become very popular. The game is usually played at events where beverages are served, and it is often challenging to simply put down a drink without spilling it to take one's turn tossing beanbags. The score of the game may also become confused. Currently numerous outdoor sporting activities are conducted without the benefit of a scoreboard. Such outdoor sporting activities are often conducted at sporting sites where because of various reasons (such as expenses, vandalism, theft, etc.) it is generally unfeasible to install permanent on-site scoreboard(s).

Certain other sporting events have been historically conducted without scoreboards. This may be illustrated by horseshoeing, volleyball, shuffle-boarding, and the recent surge of corn hole contests. These are typically played at a public park or similar accessible sites under circumstances wherein such scoring devices cannot be adequately protected against theft, vandalism, etc. Consequently, such sporting participants and players are forced to mentally keep track of the scores and announce the score to each participant upon commencement of each series of throws. Also, these participants also tend to travel considerable distances to meets attended by other players who likewise have traveled considerable distances to the meet. Under such circumstances, it becomes most difficult to make available a mechanical or manually visible means (other than mental) for displaying the meet scores. It is generally unfeasible to provide at these sites a scoreboard which may be effectively used by the players, yet will afford adequate protection against theft, vandalism, etc. Considering this background, it would be beneficial to have an inexpensive, reliable, portable, and easily operated scoring system for these games and contests.

Although cornhole is extremely popular, the game has only been in existence for 15-20 years. It has considerable room to continue growing and this is a great time to get in on the game's rising appeal. It has quickly developed into a professional sport with national television contracts with ESPN, CBS and other television networks, and there are thousands of local tournaments held for casual players around the country throughout the year. Still, despite millions of passionate players, there are no convenient, easy-to-see scoreboards on the market! Remembering the score after each "inning" can be challenging for professional and recreational players alike. A special 21-point electronic score device for games could be a revolutionizing solution.

Problem Solved

The improvement and problem solved as to a special 21-point electronic score device for games such as Corn Hole include the world's first portable, easy-to-see electronic scoreboard designed specifically for the popular backyard game of cornhole. It is an easy-to-see electronic scoreboard made of durable materials in a compact configuration with a fold-in base for easy storage, portability, and easy set-up. The scoreboard can be used for any game played to twenty-one (21) but will be marketed specifically to cornhole players. It can be used on open ground, a solid floor or pavement, making it good for indoor and outdoor play and contests.

Prior Art

As far as known, there are no special 21-point electronic score devices for games such as Corn Hole or the like. It is believed that this product is unique in its design and technologies. A novelty search revealed:

A. A Chinese patent CN201744149U issued to Li Jinhui in 2010 called a Portable light-emitting diode (LED) match scoring display. The utility model discloses a portable light-emitting diode (LED) match scoring display, which belongs to the technical field of athletic equipment. The portable LED match scoring display comprises a power supply, a digital counting display and a device, wherein the digital counting display is electrically connected with the power supply; and the device is arranged on the match scoring display and is used for adjusting numbers on the digital counting display. The portable LED match scoring display is simply structured, convenient to carry and easy and novel to operate and can adapt to various match occasions B. A Chinese patent CN108992906A issued to Li Peicheng et al. in 2018 entitled a Portable score indicator. The invention discloses a kind of portable score indicators, it is related to display device technology field, under unused state, scoring board is turned in accommodating groove, limited post then passes through support bar while being embedded in the first limit hole and the second limit hole, can easily be carried by handle at this time; When being scored, limit hole is fully dialing out first, scoring board is rotated to the direction away from accommodating groove again, until rotational angle is greater than 180 degree, the end of scoring board and support base is respectively placed on work top, score display screen reveals completely at this time, scoring board is turned into suitable angle according to the needs of users, it is rotated further by support bar, until adjustment hole and the second limit hole are coaxial, adjustment hole is inserted into the second limit hole by limit hole again, to maintain the fixation of entire scoring board, not only have the advantages that portable, also there is various viewing angle, considerably increase convenience.

C. A Korean patent KR20060036309A issued to Park Jae-y in 2006 and named a Portable score board. The present invention relates to a portable scoreboard and a structure that can display the results of the game made in the indoor and outdoor with a simple and convenient switch operation. The portable scoreboard according to the present invention is portable and has a feature that can be used as a scoreboard made indoors and outdoors by a simple switch operation. In addition, the present invention has a feature that can be used anywhere by configuring to use a variety of power sources. In addition, the present invention adds a clock function, so that it can be used even when not used as a scoreboard and adds a wireless function to enable wireless control of the display signal. In addition, the present invention is configured to stand up independently in the structure to increase the ease of use. Scoreboard, portable D. A U.S. Pat. No. 3,922,805 issued to Krug in 1975 and called a volleyball score display device. A volleyball score display device designed to be detachably secured at an elevated position to one of the volleyball net support standards by means of a clamping assembly, wherein the score display components of the device consist of two pairs of sets of flexible numbered panels which are secured to and depend from a horizontal clamping support wherein one set of such panels is displayed to the left-center of court and the other set displayed to the right-center of a playing court such that the respective pairs of flexible numbered panels within the respective sets may be flipped over the support as required to display the current respective team scores during the progress of a volleyball game.

E. U.S. Pat. No. 5,025,748 issued to Pettis in 1991 entitled a Portable scoring device. The present invention provides a portable scoring device which includes a retractable and extendable post section equipped with a ground penetrating tip and a foot brace for driving and anchoring the post section into the ground, a main frame for retractably housing the post section and supporting the post section in an extended and ground penetrating position, a score display panel affixed to the frame, and a latching mechanism for latching the post section to the frame in the extended and retracted position.

F. U.S. Pat. No. 6,725,107 issued to MacPherson in 2004 called an electronic scorekeeping device and system therefor. An electronic scorekeeping device is disclosed which allows a user to electronically document data relating to events of a sports game. This data is transferred in real-time in a system according to the invention via a communication means to a central database. The central database may be coupled to a server computer which presents a web site whereby public users may access statistical information relating to a given sports game while the game is still in progress, as well as at and following the conclusion of the game. The web site may present archives of previously played games, and access thereto may be restricted using a username and/or password. The data transfer to the database may be a live feed, or automatic transfers may be scheduled at predetermined time intervals. The device itself is customizable such that the data being gathered can be tailored to suit the specific sport being played. The user may further customize the menu-based screens displayed on the device to eliminate the prompting for any extraneous data that is not desired by the user.

G. U.S. Pat. No. 10,406,423 issued to Clarke in 2019 named a Scorekeeping device for beanbag game. The invention is directed to a scorekeeping device for a beanbag game. The device provides a forked lower body and a cylindrical upper body. The fork points of the lower body may be inserted into mounting brackets on the bottom surface of the frame of a beanbag goal. The upper body provides scorekeeping discs which are movably mounted on two semicircular rings, and two cup holders which may be used to hold the users' drinks while the users throw beanbags at a goal. The lower body easily folds upward on the upper body for storage.

H. US Patent Application 2010/0050926 submitted by Volack et al. in 2010 entitled a Horseshoe scoreboard. A horseshoe scoreboard for keeping score in a horseshoes game is provided. The horseshoe scoreboard comprises a planar board having a top surface, a bottom surface, a top edge, a bottom edge substantially opposite the top edge, a first side edge between the top edge and the bottom edge, and a second side edge opposite the first side edge. A separation line extends along the top surface of the board creating a first scoring section and a second scoring section with the separation line positioned substantially halfway between the first side edge and the second side edge and the separation line being substantially parallel to the first side edge and the second side edge. A first series of first apertures is formed in the top surface of the board in the first scoring section with a first peg releasably receivable within one of the first apertures. A second series of second apertures are formed in the top surface of the board in the second scoring section with a second peg releasably receivable within one of the second apertures. A first player indication mark is formed in the first scoring section adjacent the top edge of the board and a second player indication mark is formed in the second scoring section adjacent the top edge of the board.

I. US Patent Application 2015/0360114 submitted by Chung in 2015 titled AUTOMATED SCORING SYSTEM FOR TABLE TENNIS. Described are systems and methods for automatically scoring a table tennis game. A system for automatically scoring a table tennis game may include a sensor, a microcontroller, a display, a speaker, a table tennis net support, and/or a power supply. Methods for automatically scoring a table tennis game comprise indicating that a serve may proceed; detecting a vibration or absence of a vibration formed by contact between a table tennis ball with a table tennis table and/or between a table tennis ball and a table tennis net; determining which player served; determining if a point should be awarded based on detecting a vibration or absence of vibration; modifying the score of a table tennis game; displaying the score of a table tennis game; determining if a sensor is operational; and/or playing a sound effect.

J. US Patent Application 2016/0121195 by Brown in 2016 named a PORTABLE STATUS INDICATOR. A portable status indicator apparatus includes a display unit, a display element, and an elongate shaft. The display unit has a plurality of display regions that are cumulatively viewable from 360 degrees around the display unit. The display element has a plurality of actuatable indicators for displaying a status relating to an event. Each actuatable indicator of the plurality of actuatable indicators is coupled to a display region of the plurality of display regions. The elongate shaft has a top end and a bottom-end, and the display unit is coupled to the top end.

As can be observed, none of the prior art has anticipated or caused one skilled in the art of scoring devices or systems to see this invention by Klotz et al. as obvious to a person skilled in the ordinary art of the industry. The special 21-point electronic score device for games such as Corn Hole called Scorebox21 provides an answer to the world's first portable, easy-to-see electronic scoreboard designed specifically for the popular backyard game of cornhole.

SUMMARY OF THE INVENTION

This special 21-point electronic score device for games such as Corn Hole is the world's first portable, easy-to-see electronic scoreboard designed specifically for the popular backyard game of cornhole. It is made of durable materials like hard plastic with a fold-in base and includes 42 LEDs (21 on each side) stacked in the traditional score tower style that allows it to be used any time of day or night. It stands approximately fifty (50) inches high in a preferred embodiment when in use and then can fold down to approximately thirty-six (36) inches for easy storage and portability. It comes with a handle on one side for convenient carrying, a drink holder at the back or alternatively on each side and a compartment on top to hold a phone in place for the purpose of video recording competitive games. In addition, the scoreboard can be used for any game played to 21 but will be marketed specifically to cornhole players. The target audience for special 21-point electronic score device called Scorebox21 is men ages 18-49, but it is believed that there will also be considerable interest from women and children looking for a unique, practical gift for their cornhole-playing husbands, fathers, boyfriends, etc.

The preferred embodiment of a special 21-point electronic score device for games such as Corn Hole is: A special 21-point electronic score device 30 for corn hole games made of durable materials and comprised of: (a) a top section 80 which supports a scoring board 40 with a series of lights 60 and a series of push-buttons 50, said top section having a compartment 90 which contains a set of batteries 100 to power and energize the lights when the push-buttons are operated and said top section having a handle 70 to carry the device 30; (b) the top section 80 further comprised of a top horizontal member 82T, a bottom horizontal member 82B; a pair of vertical members 84 consisting of a left member 84L and right member 84R; a fixedly secure means 86 for connecting top 82T, bottom 82B, left 84L, and right 84R members to configure the top section 80 as a rectangular support of the scoring board 40; (c) the scoring board 40 further comprised of a means 43 to connect designed scoring board 40 to top section 80, an advertising area 41, an outer surface 45OS, and an inner surface 45IS and said "42" lights 60 configured as numbers 42A alongside for team/individual A and as numbers 42B alongside for each team/individual B, and a means 43 to connect designed scoring board 40 to top section 80; (d) a leg/support section 120 further comprised of a pair of vertical and generally upward legs 121 (left and right 121L and 121R), a recess 122 in leg section/support structure 120 to accept configuration 134 at end of angle brace 133, and a reinforced webbing 125 interior to the legs 121L and 121R as strengthening; (e) a means 132 to pivotally secure the top section 80 to the leg/support section 120 which consists of an aperture/recess 87 at lower end of members 84R, L to accept a pivot/pin/hinge 128; (f) a stabilizing base 130 with an angle brace 133 to fixedly connect and end configuration 134 of said angle brace 133 of the stabilizing base 130 to the leg/support section 120 at a recess 122; (g) a means 135 to pivotally connect the stabilizing base 130 to the leg section/support structure 120 wherein the top section 80, leg/support section 120, and stabilizing base 130 when interconnected provide the special 21-point electronic score device 30 which when set-up provides LED lighting that allows the score to be seen from far away and in low light or at night and when folded-up is compact and portable and wherein the 21-point electronic score device 30 can be used with at least one type of game. The newly concepted and developed special 21-point electronic score device can be manufactured at low volumes by very simple means and in high volume production by more complex and controlled systems.

OBJECTS AND ADVANTAGES

There are several objects and advantages of the special 21-point electronic score device for games such as Corn Hole. There are currently no known electrical, electronic, or mechanical scoring devices that are effective at providing the objects of this invention.

The special 21-point electronic score device for games such as Corn Hole has various advantages and benefits:

| Item | Advantages |
|---|---|
| 1 | Has LED lighting that allows the score to be seen from far away and in low light or at night |
| 2 | Is a compact configuration with a fold-in base for easy storage |
| 3 | Is portable with an easy to carry handle, is relatively light total weight, and is very easy to store and transport |
| 4 | Is made of readily available and durable materials |
| 5 | Is easy and fast to set-up |
| 6 | Is versatile and can be used for any game played to twenty-one (21) |
| 7 | Can be used on open ground, a solid floor or pavement, making it good for indoor and outdoor play and contests. Unlike many plastics or metal score towers that utilize a stake to anchor it into the ground, SB21's specially designed base allows it to be stable on any surface, including asphalt, concrete, carpet, tile, wood or grass |
| 8 | Is powered by three AA batteries with optional rechargeable batteries (number and voltages an example and not a limitation) |

-continued

| Item | Advantages |
|---|---|
| 9 | Has optional compartment for Smart phones to support filming and drink holders |
| 10 | Has a configuration and design that can be priced competitively if not lower than other products currently on the market |

Finally, other advantages and additional features of the present the special 21-point electronic score device will be more apparent from the accompanying drawings and from the full description of the device. For one skilled in the art of portable scoring devices for indoor and outdoor use, it is readily apparent and understood that the features shown in the examples with this product are readily adapted to other types of electric/electronic scoring systems and devices.

DESCRIPTION OF THE DRAWINGS—FIGURES

The accompanying drawings, which are incorporated in and constitute a part of this specification, illustrate an embodiment of the special 21-point electronic score device for games such as Corn Hole that is preferred. The drawings together with the summary description given above and a detailed description given below explain the principles of the special 21-point electronic score device. It is understood, however, that the special device is not limited to only the precise arrangements and instrumentalities shown.

Figure 1C:
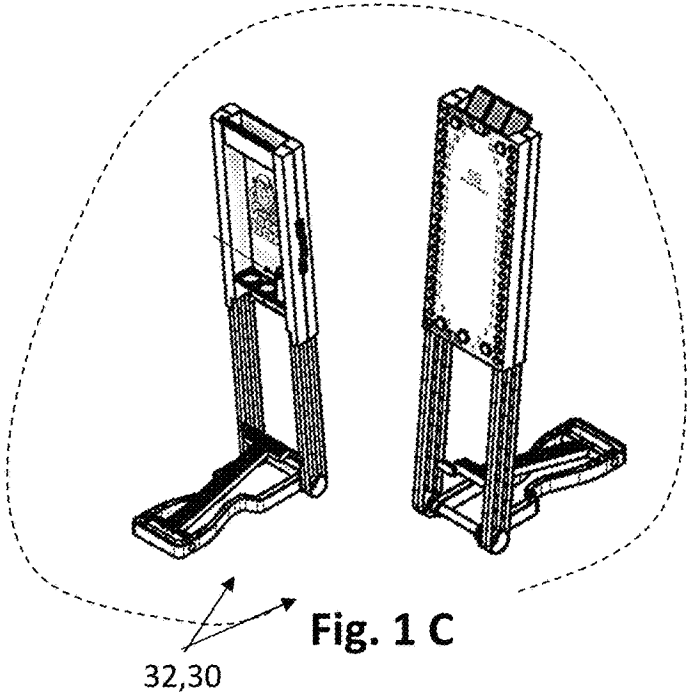
Figure 1A:
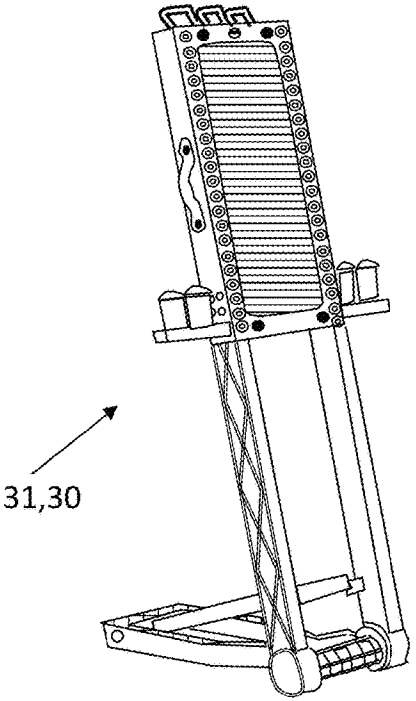
Figures 2A, 2B, 2C, 2D, 2E:
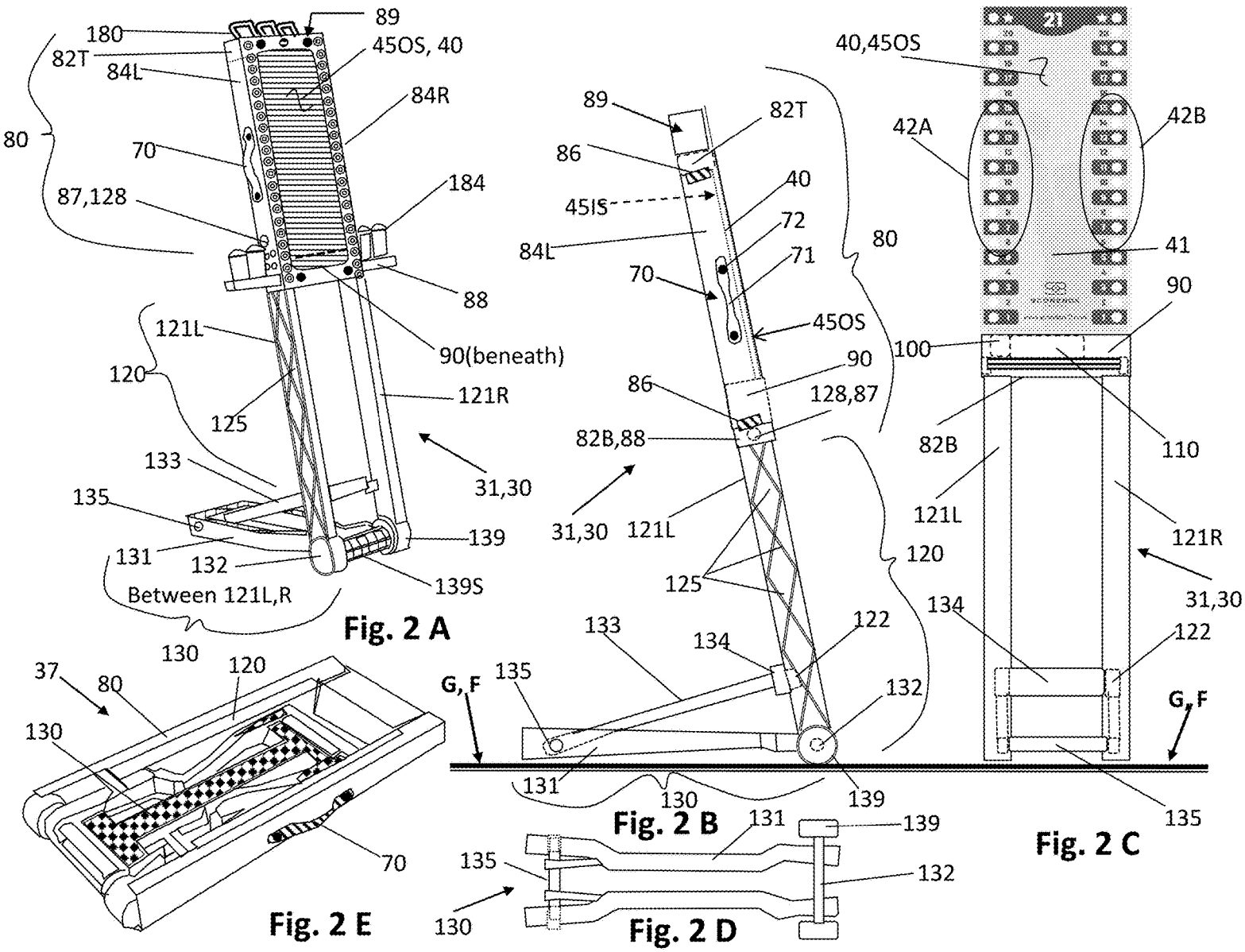
Figs 2A-2E show details of components and features

FIGS. 1A through 1C are sketches of several prototypes and the general layout of the face of the scoreboard for a special 21-point electronic score device for games such as Corn Hole.

FIGS. 2A through 2E are sketches of the general automatic out a special 21-point electronic score device for games such as Corn Hole with components and features shown.

Figure 3C:
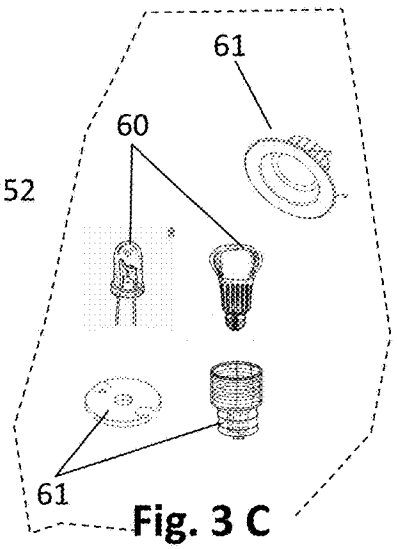
Figure 3B:
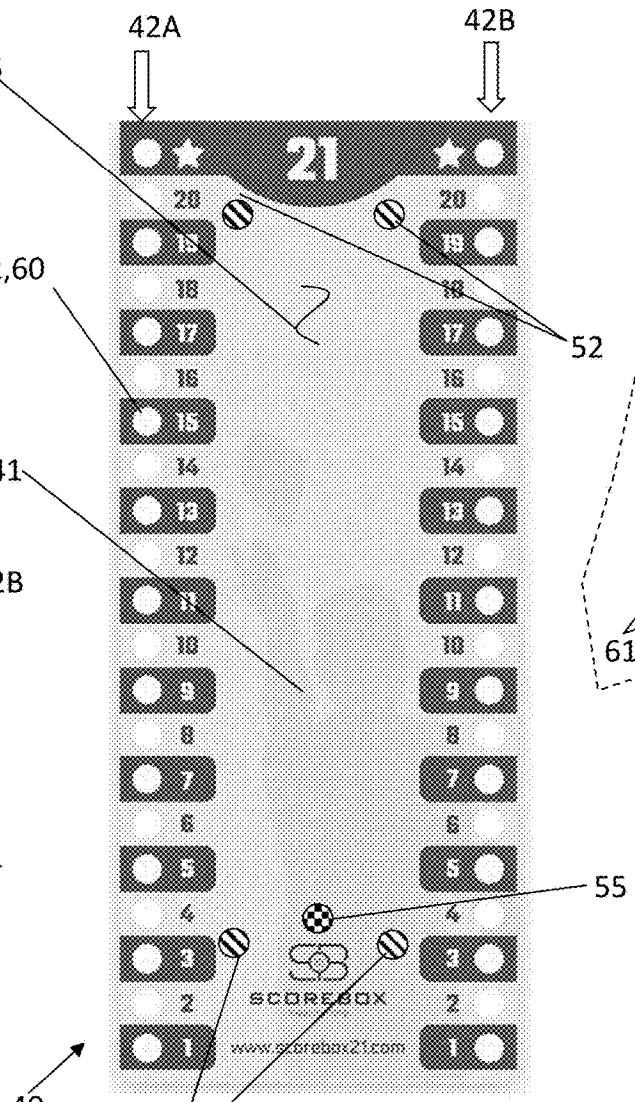
Figure 3A:
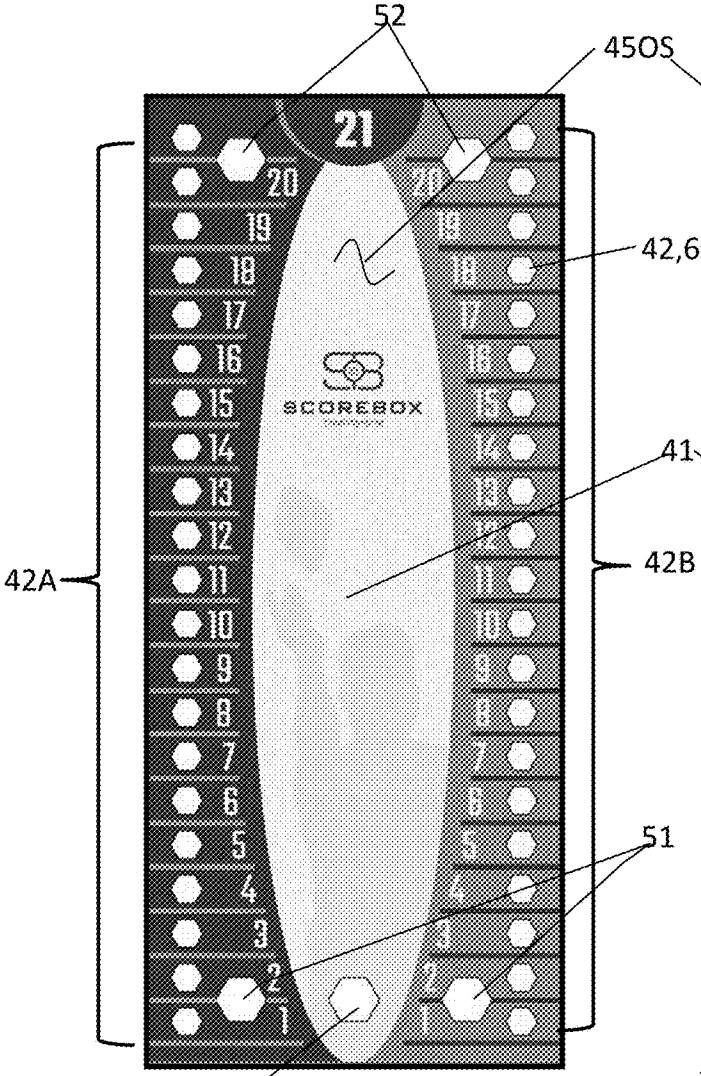

FIGS. 3A through 3C are sketches of the board faces and lights for a special 21-point electronic score device for games such as Corn Hole along with components and features denoted.

Figure 4C:
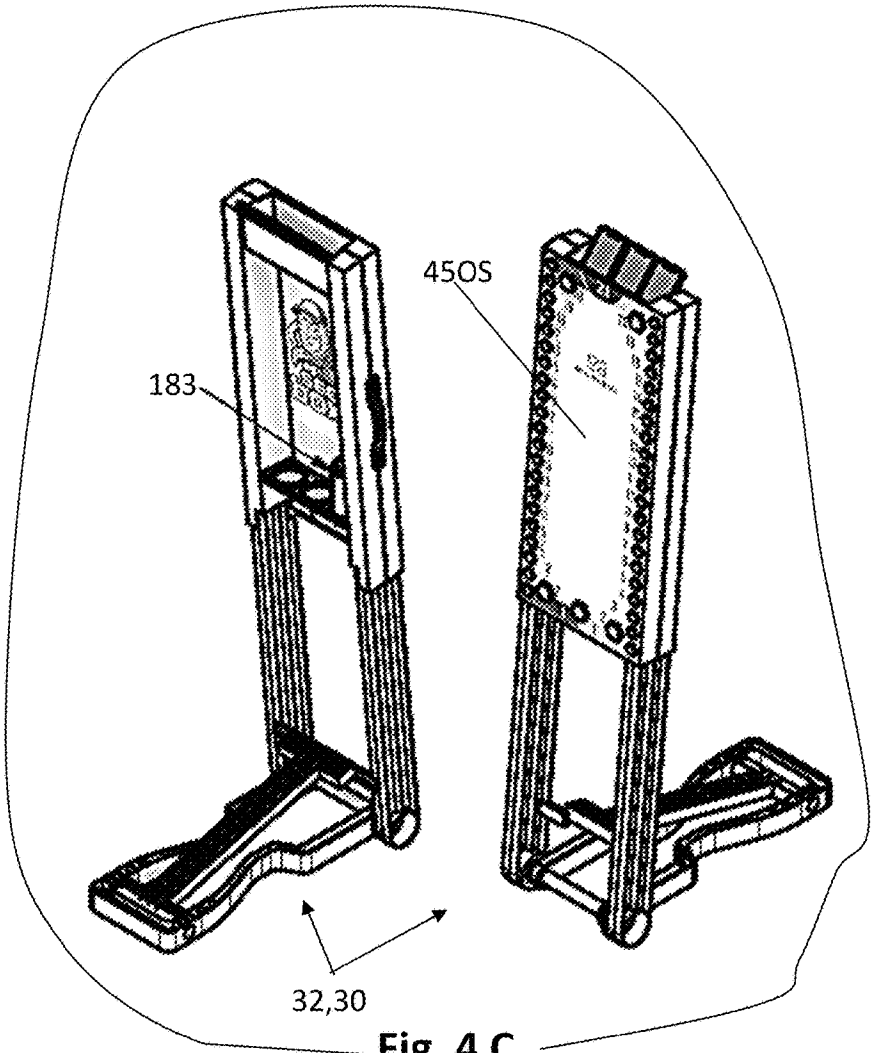
Figure 4B:
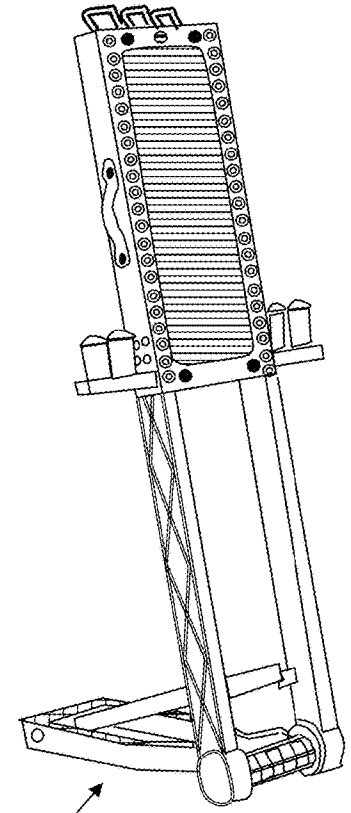
Figure 4A:
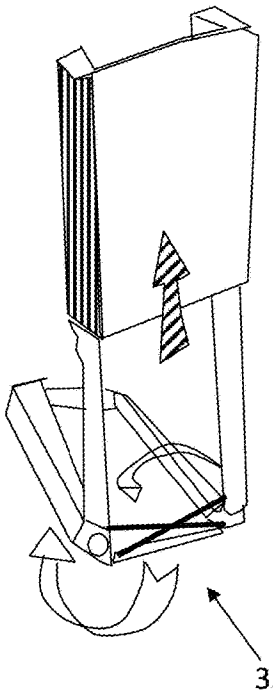

FIGS. 4A through 4C are sketches of the original concepts and prototypes of the special 21-point electronic score device for games such as Corn Hole along with components and features portrayed.

Figure 5B:
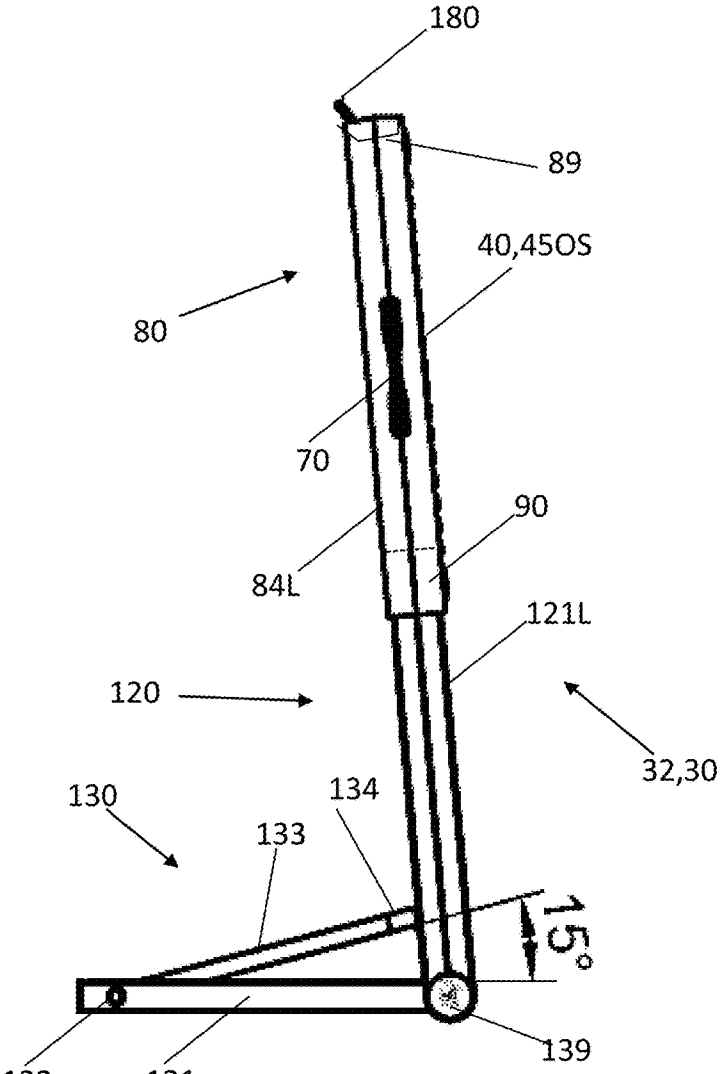
Figure 5A:
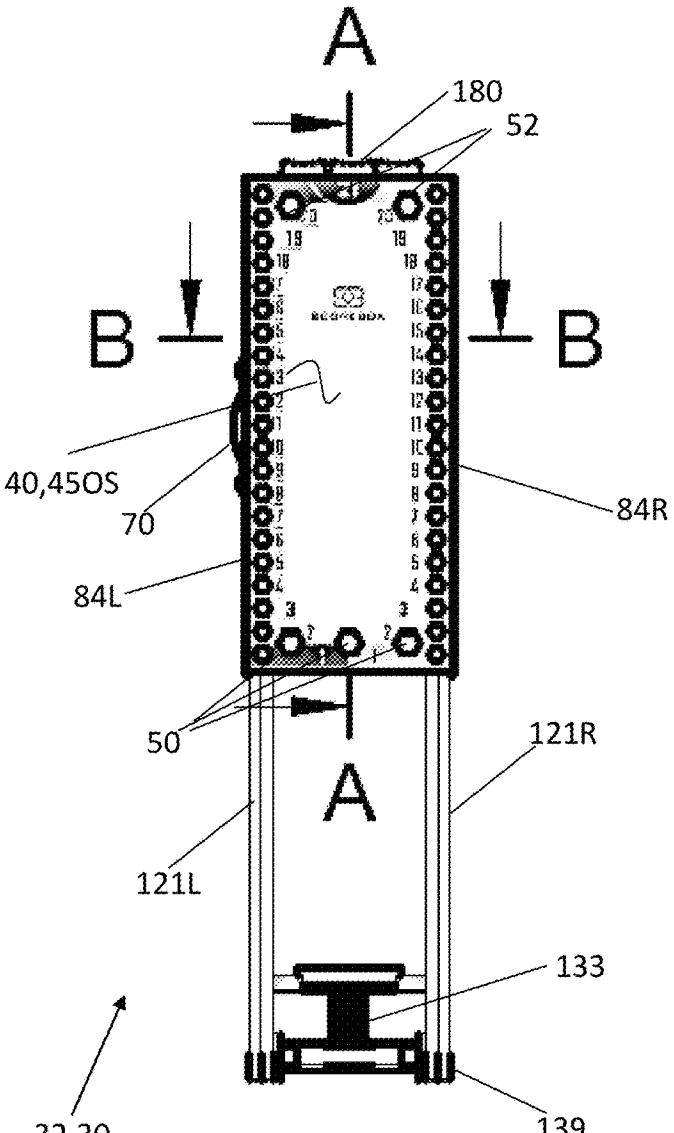
Figures 6A, 6B, 6D, 6E:
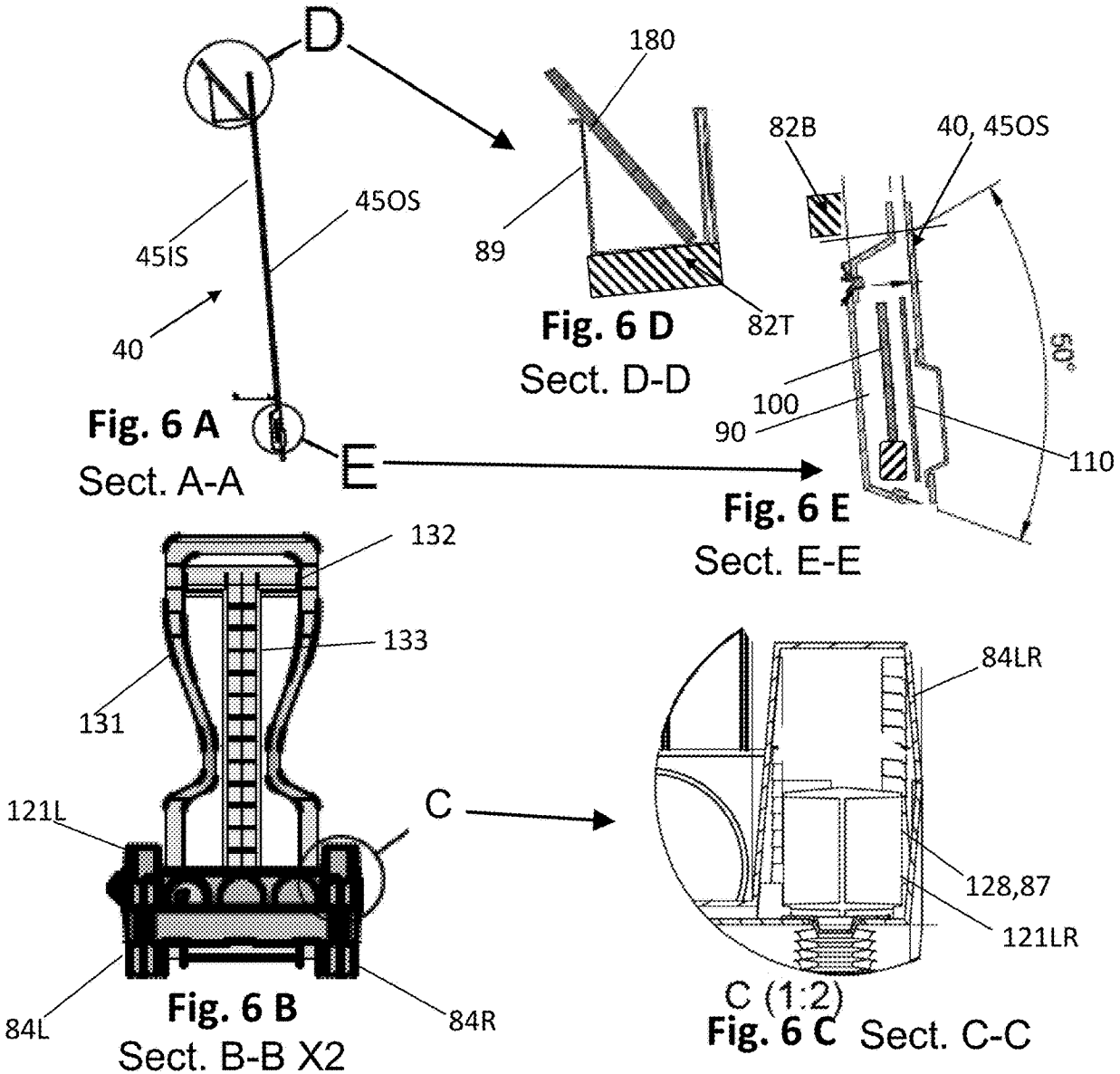

FIGS. 5A and 5B are front and side sketches of the latest prototype of the special 21-point electronic score device for games such as Corn Hole along with components and features denoted.

FIGS. 6A through 6E are sketches of details for the latest prototype of the special 21-point electronic score device for games such as Corn Hole along with components and features denoted.

Figure 7:
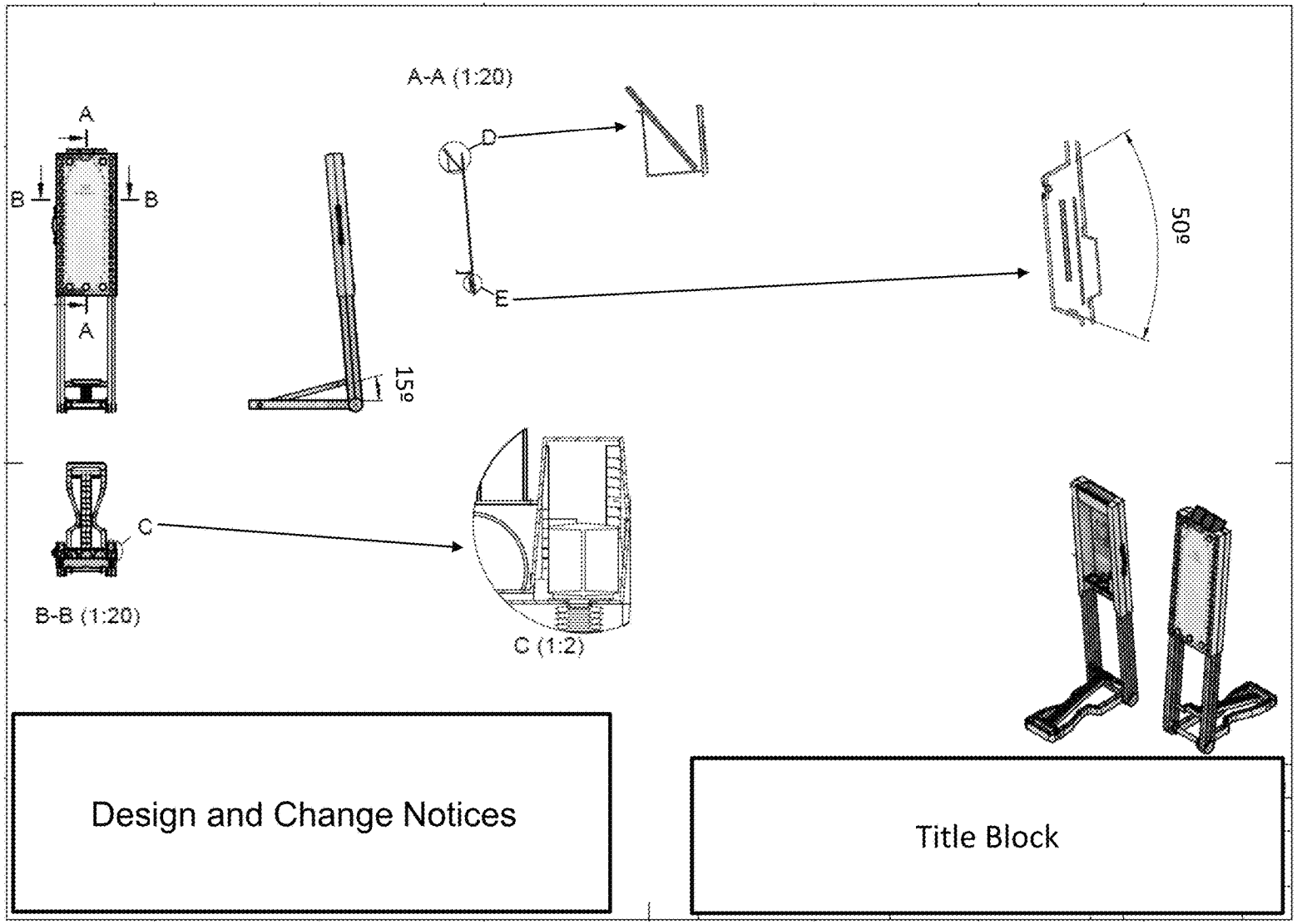

FIG. 7 is a design sheet for the latest prototype of the special 21-point electronic score device for games such as Corn Hole along with components and features denoted.

Figure 8B:
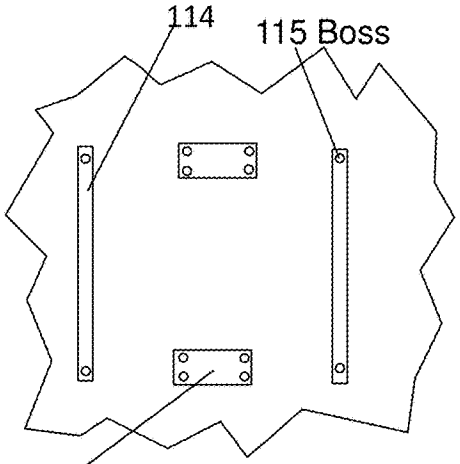
Figure 8A:
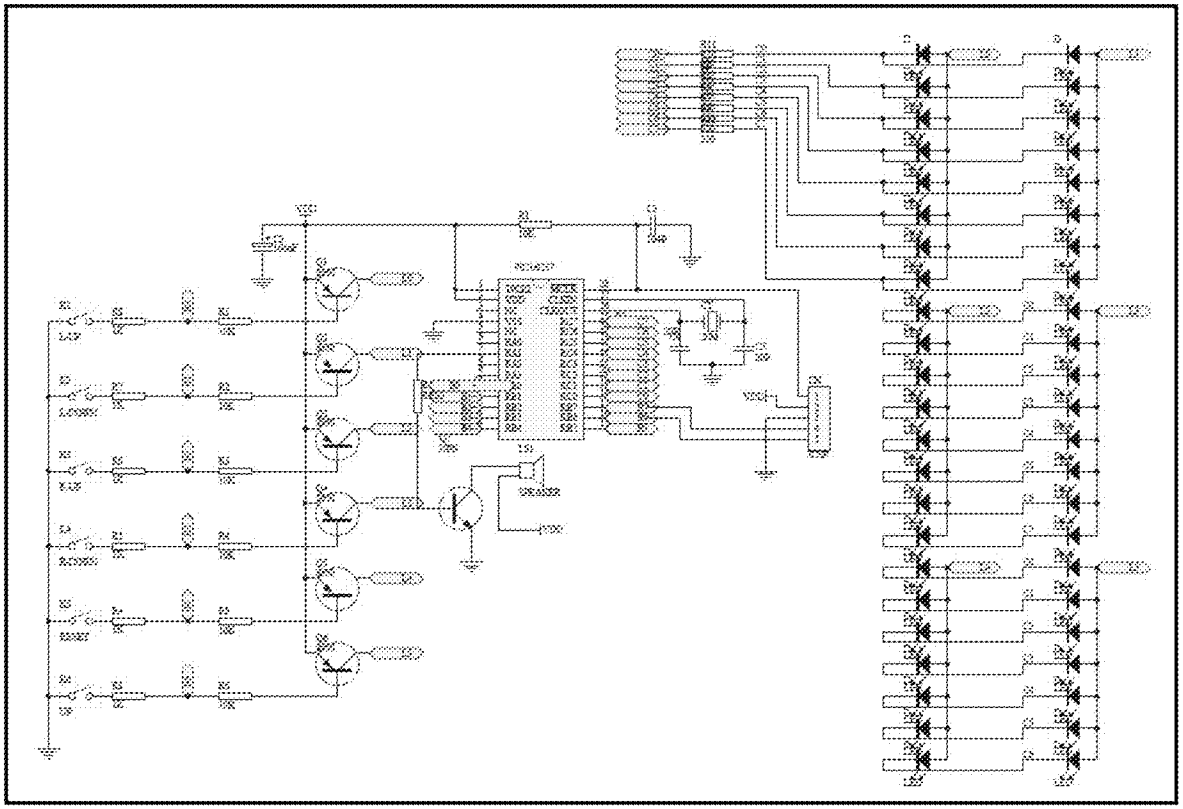
Figure 8C:
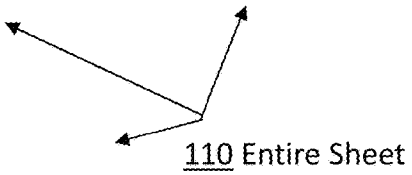
Figure 8C:
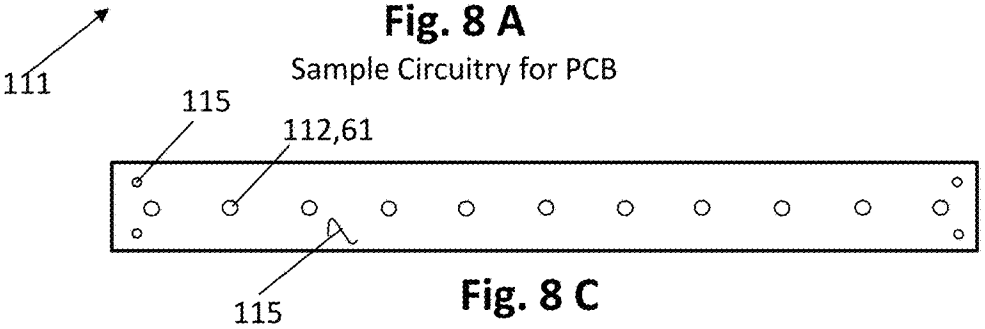
Figure 9A:
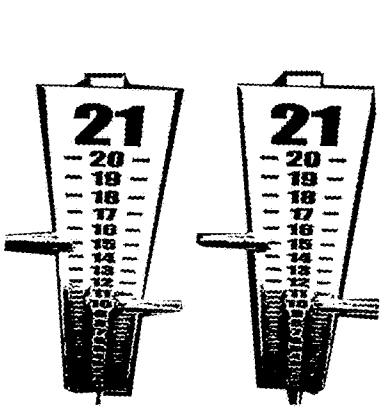
Figure 9B:
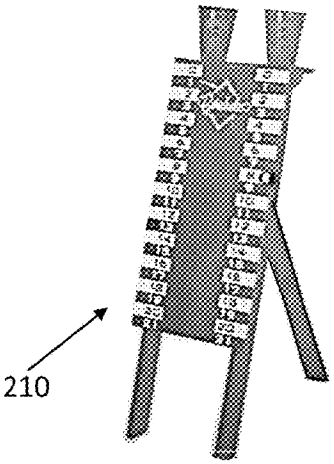
Figure 9C:
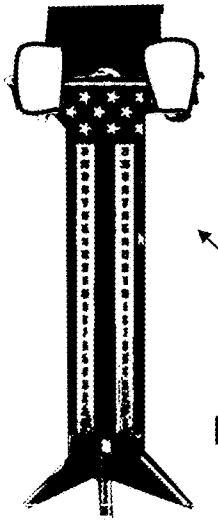
Figure 9D:
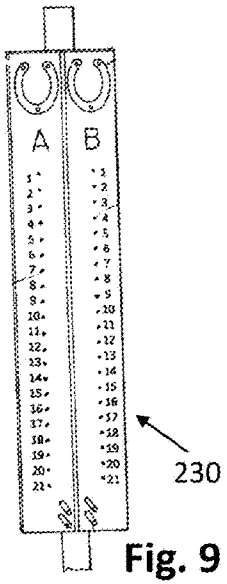
Fig. 9 D Prior Art
Figure 9E:
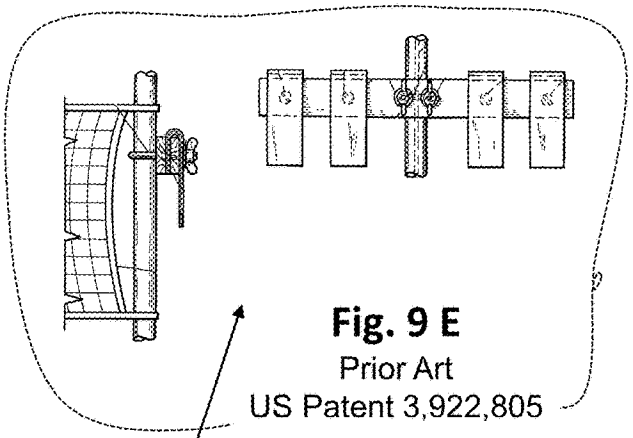
Fig. 9 E Prior Art
Figure 9F:
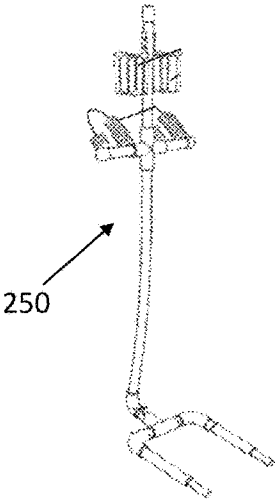
Fig. 9 F Prior Art

FIGS. 8A through 8C are sample or typical schematics for the electrical system for the latest prototype of the special 21-point electronic score device for games such as Corn Hole.

FIGS. 9A through 9F are sketches of prior art for scoring systems like the special 21-point electronic score device for games such as Corn Hole along with components and features denoted.

Figure 10A:
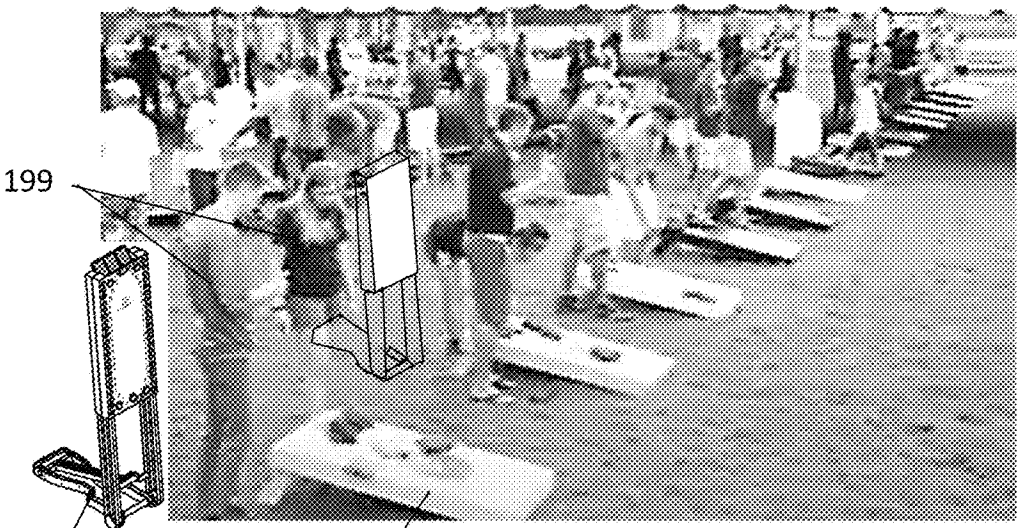
Figure 10B:
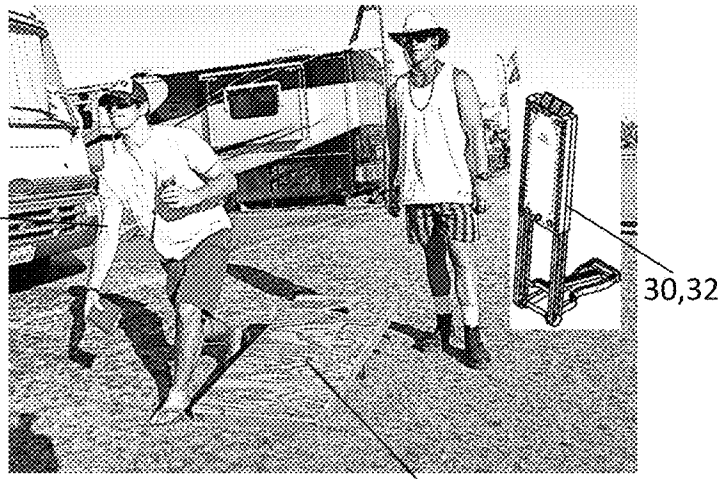

FIGS. 10A and 10B are sketches of the scoring systems like the special 21-point electronic score device being used at games or contests such as Corn Hole.

DESCRIPTION OF THE DRAWINGS—REFERENCE NUMERALS

The following list refers to the drawings:

TABLE B

Reference numbers

| Ref # | Description |
|---|---|
| 30 | special 21-point electronic score device 30 for games such as Corn Hole |
| 31 | first prototype 31 of a special 21-point electronic score device 30 |
| 32 | current prototype 32 of special 21-point electronic score device 30 |
| 35 | first concept drawing of special 21-point electronic score device 30 |
| 37 | folded, ready to transport as portable 37 special 21-point electronic score device 30 for games such as Corn Hole |
| 39 | design sheet 39 with details and of features and components for the special 21-point electronic score device 30 |
| 40 | designed scoring board 40 surface of Score Box Twenty-One (TM) of special 21-point electronic score device 30 accompanied with lights 60 and control push buttons 50 |
| 41 | advertising space 41 on designed scoring board 40 |
| 42 | twenty-one (21) numbers 42 alongside for each team |
| 42A | numbers 42A alongside for team/individual A |
| 42B | numbers 42B alongside for each team/individual B |
| 43 | means 43 to connect designed scoring board 40 to top section 80 such as fasteners (threaded, rivet etc.) or adhesive |
| 45 | main scoreboard 45 |
| 45OS | outer surface 45OS of main scoreboard 45 |
| 45IS | inner surface 45IS of main scoreboard 45 |
| 50 | control buttons 50 (push or toggle, etc.) to control lights 60 |
| 51 | a push-button or toggle switch to add/increase/go-up 51 |
| 52 | a push-button or toggle switch to subtract/decrease/go-down 52 |
| 55 | a push-button or toggle switch to reset 55 lights 60 |
| 60 | lights 60 preferred Light Emitting Diodes (LED) or equal-optional DC voltage (1.5, 9, 12 Volt) or AC 120-volt nominal-such as incandescent-bulbs, fluorescent lamps, compact fluorescent lamps (CFL), halogen lamps, or the next relatively small, bright, low energy, and available with multiple color |
| 61 | series of sockets 61 for connecting light bulbs 60 through the electronic boards 110, 111 to the power/batteries 100 |
| 62 | protective and/or colored covers 62, preferred transparent or translucent |
| 70 | carrying handle 70 |
| 71 | strap 70 made of cloth/fabric, leather, flexible polymer, metal or equal having strength to carry device 30 and flexibility |
| 72 | means for securing 72 strap 70 to top section 80 such as threaded fastener, rivet, shaft/rod and keeper, adhesive, etc. |
| 80 | top section 80 to support designed scoring board 40 and attached to board 40 with means 43 |
| 82T | top horizontal structure/rail/member 82T of top section 80 at junction of top section 80 and telephone support pan 182 in recess 89 |
| 82B | bottom horizontal structure/rail/member 82B of top section 80 at junction of top section 80 and leg/support section 120 |
| 84 | vertical structure/rail/member 84 of top section Left 84L or Right 84R |

TABLE B-continued

| Reference numbers | |
|---|---|
| Ref # | Description |
| 86 | a fixedly secure means 86 for connecting top horizontal structure/rail/member 82T to vertical structure/rail/member 84 of top section Left 84L or Right 84R and bottom horizontal structure/rail/member 82B vertical structure/rail/member 84 of top section Left 84L or Right 84R at the one end and opposite end of all the described members-fasteners (threaded, rivet etc.) or adhesive or integrally molding or casting, welding, brazing, soldering and the like, the top section 80 inner surface 450S of main scoreboard 45 to the outside face of the combined four members (82T, 84R, 82B and 84L) |
| 87 | aperture/recess 87 at lower end of legs 84R, L to accept pivot/pin/hinge(s) 128 to enable a pivotally secured connection at junction of top section 80 and leg/support section 120 |
| 88 | extension or cantilever strut(s) 88 to support drink holder structure 182 ring, recess, or the like |
| 89 | telephone recess compartment 89 for telephone support pan 182 |
| 90 | compartment 90 for electronics 110 and batteries 100 below structure 82B and above support section 120 |
| 100 | batteries 100 (at least one) with DC voltage (1.5, 9, 12 Volt) [non-rechargeable (alkaline, small/sealed lead acid) or rechargeable type (lithium ion (Li-ion), lithium-ion polymer (LIPo), Nickle cadmium (NiCd), Nickle metal hydride (NiMH) batteries] (number and voltages an example and not a limitation) |
| 106 | optional recharger component if one is using rechargeable batteries 100 |
| 110 | electronics 110 for controlling the lights through the push-buttons or toggles |
| 111 | typical PCB/control boards 111 under designed scoring board 40 contiguous with inner surface 45IS of main scoreboard 45 |
| 112 | boss 112 for LED like socket for others |
| 114 | PCB and battery holder mounting strips 114 |
| 115 | mounting boss 115 |
| 120 | leg section/support structure 120 |
| 121 | pair of vertical or generally upward legs 121 (left and right 121L and 121R) with some angle of leg section 120 |
| 122 | recess 122 in leg section/support structure 120 to accept configuration 134 at end of angle brace 133 |
| 125 | reinforced webbing or structure gussets of legs 121L and 121R for strengthening |
| 128 | pivot/pin/hinge(s) 128 to pivotally secure and connect through aperture/recess 87 at junction of top section 80 and leg/support section 120 |
| 130 | stabilizing base 130 pivotally connected to leg section/support structure 120 and removably connected at brace 133 and leg section/support structure 120 intersection |
| 131 | pair of horizontal bottom members 131 of stabilizing base 130 |
| 132 | pin and aperture 132 to pivotally connect stabilizing base 130 to leg section/support structure 120 |
| 133 | angle brace member 133 centered on stabilizing base 130 and removable connectable with end configuration 134 to leg section/support structure 120 at recess 122 |
| 134 | end configuration 134 of angle brace 133 of stabilizing base 130 removably connectable to leg section/support structure 120 at recess 122 |
| 135 | pin and aperture 135 to pivotally connect stabilizing base 130 to angle brace 133 |
| 139 | optional wheels 139 at intersection of stabilizing base 130 and leg section/support structure 120 |

TABLE B-continued

| Reference numbers | |
|---|---|
| Ref # | Description |
| 139S | shaft or extension 139S between wheels 139 or if none, between left and right support legs |
| 180 | smart phones 180 of users for video of game or contest |
| 183 | optional drink holder structure 183 ring, recess, or the like at the back or alternatively on each side |
| 184 | drink container 184 |
| 190 | a session 190 of corn hole by users |
| 185 | game boards 185 for Corn Hole |
| 199 | contestants, users of the boards 195 and special 21-point electronic score device 30 for games such as Corn Hole |
| 200 | Prior Art 200 stake in the ground light manual score recorder |
| 210 | Prior Art 210 large, lean-back wood manual score recorder |
| 220 | Prior Art 220 tall, mechanical scoring assembly |
| 230 | Prior Art 230 U.S. Pat. No. 10,406,423 |
| 240 | Prior Art 240 U.S. Pat. No. 3,922,805 |
| 250 | Prior Art 250 Patent Application US 2010/0050926 |
| G/F | approximately horizontal plane-ground G or pavement surface if outside and floor F if inside |

DETAILED DESCRIPTION OF PREFERRED EMBODIMENT

This invention relates to a special 21-point electronic score device for games such as Corn Hole, horseshoes, table tennis, and others. The technical field is specifically related to a kind of portable LED ball match score display, belongs to technical field of sports instruments. The invention relates generally to outdoor games and accessories, and to a score-keeping device for a corn hole contest or game. More particularly this relates to a portable, compact score indicator. The present invention relates to a portable scoreboard and structure, and more particularly, to a portable scoreboard and structure that can display the results of the game made in the indoor and outdoor by a simple switch or push-button operation and one that is convenient to carry. The present invention relates to scoring devices and more particularly to a portable, compact, retractable scoring device which may be expeditiously set-up at a sporting event.

The advantages for the special 21-point electronic score device 30 for games such as Corn Hole are listed above in the introduction. Succinctly the benefits are that the device:

A. Has LED lighting that allows the score to be seen from far away and in low light or at night B. Is a compact configuration with a fold-in base for easy storage C. Is portable with an easy to carry handle, is relatively light total weight, and is very easy to store and transport D. Is made of readily available and durable materials E. Is easy and fast to set-up F. Is versatile and can be used for any game played to twenty-one (21)

G. Can be used on open ground, a solid floor or pavement, making it good for indoor and outdoor play and contests. Unlike many plastics or metal score towers that utilize a stake to anchor it into the ground, SB21's specially designed base allows it to be stable on any surface, including asphalt, concrete, carpet, tile, wood or grass H. Is powered by three AA batteries with optional rechargeable batteries (number and voltages an example and not a limitation)

I. Has optional compartment for Smart phones to support filming and drink holders at the back or alternatively on each side J. Has a configuration and design that can be priced competitively if not lower than other products currently on the market The preferred embodiment of the special 21-point electronic score device 30 for games such as Corn is: A special 21-point electronic score device 30 for corn hole games made of durable materials and comprised of: (a) a top section 80 which supports a scoring board 40 with a series of lights 60 and a series of push-buttons 50, said top section having a compartment 90 which contains a set of batteries 100 to power and energize the lights when the push-buttons are operated and said top section having a handle 70 to carry the device 30; (b) the top section 80 further comprised of a top horizontal member 82T, a bottom horizontal member 82B; a pair of vertical members 84 consisting of a left member 84L and right member 84R; a fixedly secure means 86 for connecting top 82T, bottom 82B, left 84L, and right 84R members to configure the top section 80 as a rectangular support of the scoring board 40; (c) the scoring board 40 further comprised of a means 43 to connect designed scoring board 40 to top section 80, an advertising area 41, an outer surface 45OS, and an inner surface 45IS and said "42" lights 60 configured as numbers 42A alongside for team/individual A and as numbers 42B alongside for each team/individual B, and a means 43 to connect designed scoring board 40 to top section 80; (d) a leg/support section 120 further comprised of a pair of vertical and generally upward legs 121 (left and right 121L and 121R), a recess 122 in leg section/support structure 120 to accept configuration 134 at end of angle brace 133, and a reinforced webbing 125 interior to the legs 121L and 121R as strengthening; (e) a means 132 to pivotally secure the top section 80 to the leg/support section 120 which consists of an aperture/recess 87 at lower end of members 84R, L to accept a pivot/pin/hinge 128; (f) a stabilizing base 130 with an angle brace 133 to fixedly connect and end configuration 134 of said angle brace 133 of the stabilizing base 130 to the leg/support section 120 at a recess 122; (g) a means 135 to pivotally connect the stabilizing base 130 to the leg section/support structure 120 wherein the top section 80, leg/support section 120, and stabilizing base 130 when interconnected provide the special 21-point electronic score device 30 which when set-up provides LED lighting that allows the score to be seen from far away and in low light or at night and when folded-up is compact and portable and wherein the 21-point electronic score device 30 can be used with at least one type of game.

There is shown in FIGS. 1-10 a complete description and operative embodiment of the special 21-point electronic score device 30. In the drawings and illustrations, one notes well that the FIGS. 1-10 demonstrate the general configuration and use of this product. The various example uses are in the operation and use section, below.

The accompanying drawings, which are incorporated in and constitute a part of this specification, illustrate an embodiment of the special 21-point electronic score device 30 for games such as Corn Hole that is preferred. The drawings together with the summary description given above and a detailed description given below describe and explain the principles of the special 21-point electronic score device 30 for games such as Corn Hole. It is understood, however, that the special device 30 is not limited to only the precise arrangements and instrumentalities shown. Other examples of scoring displays and systems are still understood by one skilled in the art of such scoring devices to be within the scope and spirit shown here.

FIGS. 1A through 1C are sketches of several prototypes and the general layout of the face of the scoreboard for a special 21-point electronic score device 30 for games such as Corn Hole. Shown here are a special 21-point electronic score device 30 for games such as Corn Hole; a first prototype 31 of a special 21-point electronic score device 30; a current prototype 32 of special 21-point electronic score device 30; and a designed scoring board 40 surface of Score Box Twenty-One™ of special 21-point electronic score device 30 accompanied with lights 60 and control push buttons 50.

FIGS. 2A through 2E are sketches of the general automatic out a special 21-point electronic score device for games such as Corn Hole with components and features shown. Demonstrated here as features and components are: a special 21-point electronic score device 30 for games such as Corn Hole; a first prototype 31 of a special 21-point electronic score device 30; a folded, ready to transport as portable 37 special 21-point electronic score device 30 for games such as Corn Hole; a designed scoring board 40 surface of Score Box Twenty-One™ of special 21-point electronic score device 30 accompanied with lights 60 and control push buttons 50; an advertising space 41 on designed scoring board 40; a twenty-one (21) numbers 42 alongside for each team; numbers 42A alongside for team/individual A; numbers 42B alongside for each team/individual B; a means 43 to connect designed scoring board 40 to top section 80 such as fasteners (threaded, rivet etc.) or adhesive; a main scoreboard 45; an outer surface 45OS of main scoreboard 45; an inner surface 45IS of main scoreboard 45; a control buttons 50 (push or toggle, etc.) to control lights 60; a push-button or toggle switch to add/increase/go-up 51; a push-button or toggle switch to subtract/decrease/go-down 52; a push-button or toggle switch to reset 55 lights 60; a series of lights 60 preferred Light Emitting Diodes (LED) or equal—optional DC voltage (1.5, 9, 12 Volt) or AC 120-volt nominal—such as incandescent bulbs, fluorescent lamps, compact fluorescent lamps (CFL), halogen lamps, or the next relatively small, bright, low energy, and available with multiple color; a series of sockets 61 for connecting light bulbs 60 through the electronic boards 110, 111 to the power/batteries 100; a protective and/or colored covers 62, preferred transparent or translucent; a carrying handle 70; a strap 70 made of cloth/fabric, leather, flexible polymer, metal or equal having strength to carry device 30 and flexibility; a means for securing 72 strap 70 to top section 80 such as threaded fastener, rivet, shaft/rod and keeper, adhesive, etc.; a top section 80 to support designed scoring board 40 and attached to board 40 with means 43; a top horizontal structure/rail/member 82T of top section 80 at junction of top section 80 and telephone support pan 182 in recess 89; a bottom horizontal structure/rail/member 82B of top section 80 at junction of top section 80 and leg/support section 120; a vertical structure/rail/member 84 of top section Left 84L or Right 84R; a fixedly secure means 86 for connecting top horizontal structure/rail/member 82T to vertical structure/rail/member 84 of top section left 84L or Right 84R and bottom horizontal structure/rail/member 82B vertical structure/rail/member 84 of top section left 84L or right 84R at the one end and opposite end of all the described members [for connecting top 82T, bottom 82B, left 84L, and right 84R members to configure the top section 80 as an essentially rectangular support]—fasteners (threaded, rivet etc.) or adhesive or integrally molding or casting, welding, brazing, soldering and the like, the top section 80 inner surface 45OS of main scoreboard 45 to the outside face of the combined four members (82T, 84R, 82B and 84L); aperture/recess 87 at lower end of legs 84R, L to accept pivot/pin/hinge(s) 128 to enable a pivotally secured connection at junction of top section 80 and leg/support section 120; an extension or cantilever strut(s) 88 to support drink holder structure 182 ring, recess or the like (at the back or alternatively on each side); a telephone recess compartment 89 for telephone support pan 182; a compartment 90 for electronics 110 and batteries 100 below structure 82B and above support section 120; a set of batteries 100 (at least one) with DC voltage (1.5, 9, 12 Volt) [non-rechargeable (alkaline, small/sealed lead acid) or rechargeable type (lithium ion (Li-ion), lithium-ion polymer (LIPo), Nickle cadmium (NiCd), Nickle metal hydride (NiMH) batteries] (Note that one skilled in the art of battery powered devices understands that the number and voltages are examples and not a limitation, that there are in fact several combinations of the number and voltages possible in configurations such as shown here); an optional recharger component, if one is using rechargeable batteries 100; a set of electronics 110 for controlling the lights through the push-buttons or toggles; a typical PCB/control board(s) 111 under designed scoring board 40 contiguous with inner surface 451IS of main scoreboard 45; a series of boss(es) 112 for LED like socket for others; a PCB and battery holder mounting strips 114; a mounting boss 115; a leg section/support structure 120; a pair of vertical or generally upward legs 121 (left and right 121L and 121R) with some angle of leg section 120; a recess 122 in leg section/support structure 120 to accept configuration 134 at end of angle brace 133; a reinforced webbing or structure gussets 125 of legs 121L and 121R for strengthening; a pivot/pin/hinge(s) 128 to pivotally secure and connect through aperture/recess 87 at junction of top section 80 and leg/support section 120; a stabilizing base 130 pivotally connected to leg section/support structure 120 and removably connected at brace 133 and leg section/support structure 120 intersection; a pair of horizontal bottom members 131 of stabilizing base 130; a pin and aperture 132 to pivotally connect stabilizing base 130 to leg section/support structure 120; an angle brace member 133 centered on stabilizing base 130 and removable connectable with end configuration 134 to leg section/support structure 120 at recess 122; an end configuration 134 of angle brace 133 of stabilizing base 130 removably connectable to leg section/support structure 120 at recess 122; a pin and aperture 135 to pivotally connect stabilizing base 130 to angle brace 133; an optional wheel 139 at intersection of stabilizing base 130 and leg section/support structure 120; a shaft or extension 139S between wheels 139 or if none, between left and right support legs; a smart phone 180 of users for video of game or contest; an optional drink holder structure 183 ring, recess, or the like at the back or alternatively on each side; a drink container 184; and an approximately horizontal plane—ground G or pavement surface if outside and floor F if inside.

FIGS. 3A through 3C are sketches of the board faces 45OS and lights 60 for a special 21-point electronic score device 30 for games such as Corn Hole along with components and features denoted. Provided here are: a designed scoring board 40 surface of Score Box Twenty-One™ of special 21-point electronic score device 30 accompanied with lights 60 and control push buttons 50; an advertising space 41 on designed scoring board 40; a twenty-one (21) numbers 42 alongside for each team; numbers 42A alongside for team/individual A; numbers 42B alongside for each team/individual B; a means 43 to connect designed scoring board 40 to top section 80 such as fasteners (threaded, rivet etc.) or adhesive; a main scoreboard 45; an outer surface 45OS of main scoreboard 45; an inner surface 45IS of main scoreboard 45; a control buttons 50 (push or toggle, etc.) to control lights 60; a push-button or toggle switch to add/increase/go-up 51; a push-button or toggle switch to subtract/decrease/go-down 52; a push-button or toggle switch to reset 55 lights 60; a series of lights 60 preferred Light Emitting Diodes (LED) or equal—optional DC voltage (1.5, 9, 12 Volt) or AC 120-volt nominal—such as incandescent bulbs, fluorescent lamps, compact fluorescent lamps (CFL), halogen lamps, or the next relatively small, bright, low energy, and available with multiple color; a series of sockets 61 for connecting light bulbs 60 through the electronic boards 110, 111 to the power/batteries 100; and a protective and/or colored covers 62.

FIGS. 4A through 4C are sketches of the original concepts and prototypes of the special 21-point electronic score device 30 for games such as Corn Hole along with components and features portrayed. Denoted here are a special 21-point electronic score device 30 for games such as Corn Hole; a first prototype 31 of a special 21-point electronic score device 30; a current prototype 32 of special 21-point electronic score device 30; and a first concept drawing 35 of special 21-point electronic score device 30. One notes that FIGS. 2A-2E show details of components and features shown again in these sketches.

FIGS. 5A and 5B are front and side sketches of the latest prototype of the special 21-point electronic score device 30 for games such as Corn Hole along with components and features denoted. Demonstrated and shown here are: a special 21-point electronic score device 30 for games such as Corn Hole; a current prototype 32 of special 21-point electronic score device 30; a designed scoring board 40 surface of Score Box Twenty-One™ of special 21-point electronic score device 30 accompanied with lights 60 and control push buttons 50; a means 43 to connect (not shown) designed scoring board 40 to top section 80 such as fasteners (threaded, rivet etc.) or adhesive; an outer surface 45OS of main scoreboard 45; a control buttons 50 (push or toggle, etc.) to control lights 60; a series of lights 60 preferred Light Emitting Diodes (LED) or equal—optional DC voltage (1.5, 9, 12 Volt) or AC 120-volt nominal—such as incandescent bulbs, fluorescent lamps, compact fluorescent lamps (CFL), halogen lamps, or the next relatively small, bright, low energy, and available with multiple color; a strap 70 made of cloth/fabric, leather, flexible polymer, metal or equal having strength to carry device 30 and flexibility; a top horizontal structure/rail/member 82T of top section 80 at junction of top section 80 and telephone support pan 182 in recess 89; a bottom horizontal structure/rail/member 82B of top section 80 at junction of top section 80 and leg/support section 120; a vertical structure/rail/member 84 of top section Left 84L or Right 84R; a fixedly secures means for connecting top horizontal structure/rail/member 82T to vertical structure/rail/member 84 of top section Left 84L or Right 84R and bottom horizontal structure/rail/member 82B vertical structure/rail/member 84 of top section Left 84L or Right 84R at the one end and opposite end of all the described members-fasteners (threaded, rivet etc.) or adhesive or integrally molding or casting, welding, brazing, soldering and the like, the top section 80 inner surface 45OS of main scoreboard 45 to the outside face of the combined four members (82T, 84R, 82B and 84L); a telephone recess compartment 89 for telephone support pan 182; a compartment 90 for electronics 110 and batteries 100 below structure 82B and above support section 120; a pair of vertical or generally upward legs 121 (left and right 121L and 121R) with some angle of leg section 120; a recess 122 in leg section/support structure 120 to accept configuration 134 at end of angle brace 133; a reinforced webbing 125 or structure gussets of legs 121L and 121R for strengthening; a stabilizing base 130 pivotally connected to leg section/support structure 120 and removably connected at brace 133 and leg section/support structure 120 intersection; a pair of horizontal bottom members 131 of stabilizing base 130; a pin and aperture 132 to pivotally connect stabilizing base 130 to leg section/support structure 120; an angle brace member 133 centered on stabilizing base 130 and removable connectable with end configuration 134 to leg section/support structure 120 at recess 122; an end configuration 134 of angle brace 133 of stabilizing base 130 removably connectable to leg section/support structure 120 at recess 122; a pin and aperture 135 to pivotally connect stabilizing base 130 to angle brace 133; an optional wheel 139 at intersection of stabilizing base 130 and leg section/support structure 120; a shaft or extension 139S between wheels 139 or if none, between left and right support legs; and a smart phone 180 of users for video of game or contest.

FIGS. 6A through 6E are sketches of details for the latest prototype 32 of the special 21-point electronic score device 30 for games such as Corn Hole along with components and features denoted. Shown here are: a current prototype 32 of special 21-point electronic score device 30; a designed scoring board 40 surface of Score Box Twenty-One™ of special 21-point electronic score device 30 accompanied with lights 60 and control push buttons 50; a means 43 to connect (not shown) designed scoring board 40 to top section 80 such as fasteners (threaded, rivet etc.) or adhesive; a main scoreboard 45; an outer surface 45OS of main scoreboard 45; an inner surface 45IS of main scoreboard 45; a top section 80 to support designed scoring board 40 and attached to board 40 with means 43; a top horizontal structure/rail/member 82T of top section 80 at junction of top section 80 and telephone support pan 182 in recess 89; a bottom horizontal structure/rail/member 82B of top section 80 at junction of top section 80 and leg/support section 120; a vertical structure/rail/member 84 of top section; Right 84R; a fixedly secures means for connecting top horizontal structure/rail/member 82T to vertical structure/rail/member 84 of top section Left 84L or Right 84R and bottom horizontal structure/rail/member 82B vertical structure/rail/member 84 of top section Left 84L or Right 84R at the one end and opposite end of all the described members-fasteners (threaded, rivet etc.) or adhesive or integrally molding or casting, welding, brazing, soldering and the like, the top section 80 inner surface 45OS of main scoreboard 45 to the outside face of the combined four members (82T, 84R, 82B and 84L); a telephone recess compartment 89 for telephone support pan 182; a compartment 90 for electronics 110 and batteries 100 below structure 82B and above support section 120; a set of batteries 100 (at least one) with DC voltage (1.5, 9, 12 Volt) [non-rechargeable (alkaline, small/sealed lead acid) or rechargeable type (lithium ion (Li-ion), lithium-ion polymer (LIPo), Nickle cadmium (NiCd), Nickle metal hydride (NiMH) batteries]; an optional recharger component 106, if one is using rechargeable batteries 100; a set of electronics 110 for controlling the lights through the push-buttons or toggles; a typical PCB/control board(s) 111 under designed scoring board 40 contiguous with inner surface 45IS of main scoreboard 45; a series of boss(es) 112 for LED like socket for others; a PCB and battery holder mounting strips 114; a mounting boss 115; a pair of vertical or generally upward legs 121 (left and right 121L and 121R) with some angle of leg section 120; a recess 122 in leg section/support structure 120 to accept configuration 134 at end of angle brace 133; a reinforced webbing 125 or structure gussets of legs 121L and 121R for strengthening; a stabilizing base 130 pivotally connected to leg section/support structure 120 and removably connected at brace 133 and leg section/support structure 120 intersection; a pair of horizontal bottom members 131 of stabilizing base 130; a pin and aperture 132 to pivotally connect stabilizing base 130 to leg section/support structure 120; an angle brace member 133 centered on stabilizing base 130 and removable connectable with end configuration 134 to leg section/support structure 120 at recess 122; an end configuration 134 of angle brace 133 of stabilizing base 130 removably connectable to leg section/support structure 120 at recess 122; a pin and aperture 135 to pivotally connect stabilizing base 130 to angle brace 133; a pair of optional wheels 139 at intersection of stabilizing base 130 and leg section/support structure 120; a shaft or extension 139S between wheels 139 or if none, between left and right support legs; and a smart phone 180 of users for video of game or contest.

FIG. 7 is a design sheet for the latest prototype 32 of the special 21-point electronic score device for games such as Corn Hole along with components and features denoted. Shown here is a design sheet 39 with details and of features and components for the special 21-point electronic score device 30.

FIGS. 8A through 8C are sample or typical schematics for the electrical system for the latest prototype of the special 21-point electronic score device for games such as Corn Hole. Demonstrated are: a series of lights 60 preferred Light Emitting Diodes (LED) or equal—optional DC voltage (1.5, 9, 12 Volt) or AC 120-volt nominal—such as incandescent bulbs, fluorescent lamps, compact fluorescent lamps (CFL), halogen lamps, or the next relatively small, bright, low energy, and available with multiple color; a series of sockets 61 for connecting light bulbs 60 through the electronic boards 110, 111 to the power/batteries 100; and a protective and/or colored covers 62, preferred transparent or translucent.

FIGS. 9A through 9F are sketches of prior art for scoring systems like the special 21-point electronic score device 30 for games such as Corn Hole along with components and features denoted. Here former patents and applications for various mechanical, electrical, and electronic scoring devices are shown. These include: Prior Art 200—stake in the ground light manual score recorder; Prior Art 210—large, lean-back type wooden manual score recorder; Prior Art 220—tall, mechanical scoring assembly; Prior Art 230—U.S. Pat. No. 10,406,423; Prior Art 240—U.S. Pat. No. 3,922,805; and Prior Art 250—Patent Application US 2010/0050926. As can be seen, the special 21-point electronic score device 30 for games such as Corn Hole is a unique combination and use as described herein.

FIGS. 10A and 10B are sketches of the scoring systems like the special 21-point electronic score device 30 being used at games or contests such as Corn Hole. This is described in the Operations Section, below.

The anticipated durable materials for the special 21-point electronic score device 30 include metals, polymers, and composite materials. Polymers can include reinforced plastics and polymers such as fairly high durometer, urethane, polyurethane, Polyethylene Terephthalate (PETE or PET or PETG), High-Density Polyethylene (HDPE), Polyvinyl Chloride (PVC), Low-Density Polyethylene (LDPE), Polypropylene (PP), and Acrylonitrile butadiene styrene (ABS), thermoplastic elastomers (TPE), Acrylonitrile Styrene (ASA); Acrylonitrile Butadiene Styrene (ABS) Plastic; polycarbonate-Acrylonitrile Butadiene Styrene (PC-ABS); polylactic acid (PLA); Polyamide (PA-nylon), and Glass Filled Polyamide (reinforced nylons). The metals can be cast or sheet structures of aluminum, steel, and steel alloys. The composite materials can be various pressed fibers, cardboards, and reinforced plastic/paper and likely needs waterproof coatings for outdoor use.

The details mentioned here are exemplary and not limiting. Other specific components and manners specific to describing a special 21-point electronic score device for games such as Corn Hole may be added as a person having ordinary skill in the field of scoring devices and portable score displays for outdoor games and accessories, and to a scorekeeping device.

Operation of the Preferred Embodiment

The special 21-point electronic score device 30 for games such as Corn Hole has been described in the above embodiment. The manner of how the device operates is described below. One notes well that the description above and the operation described here must be taken together to fully illustrate the concept. The preferred embodiment of the special 21-point electronic score device for corn hole is: A special 21-point electronic score device 30 for corn hole games made of durable materials and comprised of: (a) a top section 80 which supports a scoring board 40 with a series of lights 60 and a series of push-buttons 50, said top section having a compartment 90 which contains a set of batteries 100 to power and energize the lights when the push-buttons are operated and said top section having a handle 70 to carry the device 30; (b) the top section 80 further comprised of a top horizontal member 82T, a bottom horizontal member 82B; a pair of vertical members 84 consisting of a left member 84L and right member 84R; a fixedly secure means 86 for connecting top 82T, bottom 82B, left 84L, and right 84R members to configure the top section 80 as a rectangular support of the scoring board 40; (c) the scoring board 40 further comprised of a means 43 to connect designed scoring board 40 to top section 80, an advertising area 41, an outer surface 45OS, and an inner surface 45IS and said "42" lights 60 configured as numbers 42A alongside for team/individual A and as numbers 42B alongside for each team/individual B, and a means 43 to connect designed scoring board 40 to top section 80; (d) a leg/support section 120 further comprised of a pair of vertical and generally upward legs 121 (left and right 121L and 121R), a recess 122 in leg section/support structure 120 to accept configuration 134 at end of angle brace 133, and a reinforced webbing 125 interior to the legs 121L and 121R as strengthening; (e) a means 132 to pivotally secure the top section 80 to the leg/support section 120 which consists of an aperture/recess 87 at lower end of members 84R, L to accept a pivot/pin/hinge 128; (f) a stabilizing base 130 with an angle brace 133 to fixedly connect and end configuration 134 of said angle brace 133 of the stabilizing base 130 to the leg/support section 120 at a recess 122; (g) a means 135 to pivotally connect the stabilizing base 130 to the leg section/support structure 120 wherein the top section 80, leg/support section 120, and stabilizing base 130 when interconnected provide the special 21-point electronic score device 30 which when set-up provides LED lighting that allows the score to be seen from far away and in low light or at night and when folded-up is compact and portable and wherein the 21-point electronic score device 30 can be used with at least one type of game.

The special 21-point electronic score device 30 is operated by carrying the electronic score device 30 to the corn hole field 190 as a compact unit. The device 30 is carried by the handle 70. Then the three main sections are "opened". The top section 80 used to support designed scoring board 40 is rotated/pivoted from the leg/support section 120 by a pivot/pin/hinge(s) 128 (which pivotally secures and connects through aperture/recess 87 at junction of top section 80 and leg/support section 120). The stabilizing base 130 is rotated away from the leg/support section 120 at a pin and aperture 132 to pivotally connect stabilizing base 130 to leg section/support structure 120. The angle brace 133 is pivotally connected to the stabilizing base 130 to angle brace 133 by a pin and aperture 135. At the opposite end of the pivot 135 on the angle brace member 133 is removably connectable with end configuration 134 of the brace 133 which is placed into the recess 122 of the leg section/support structure 120. Once the three sections 80, 120, and 130 are rotated and connected, the device is essentially standing vertically and perpendicular to the horizontal plane—ground G or pavement surface if outside and floor F if inside. Now the electronics can be energized by placing the batteries in place and testing the lights by using the push-button/toggles 50 to check the operation. If desired, the device may use the recharging unit 106.

FIGS. 10A and 10B are sketches of the scoring systems like the special 21-point electronic score device 30 being used at games or contests such as Corn Hole. Provided in these sketches are scenes of a session 190 of corn hole by users 195; the various types and styles of game boards 185 for Corn Hole; the contestants, users of the boards 195; and special 21-point electronic score device 30 for games such as Corn Hole current prototype 32 of special 21-point electronic score device 30.

Many uses are anticipated for the special 21-point electronic score device 30 for games. Some examples, and not limitations, of the anticipated games are shown in the following Table.

| ITEM | Type of GAME |
|---|---|
| 1 | Corn Hole |
| 2 | Horseshoes |
| 3 | Table Tennis |
| 4 | Volleyball |
| 5 | Shuffleboard |
| 6 | Badminton |

With this description it is to be understood that the special 21-point electronic score device 30 for games such as Corn Hole is not to be limited to only the disclosed embodiment of product. The features of the device 30 are intended to cover various modifications and equivalent arrangements included within the spirit and scope of the description.

While certain novel features of this invention have been shown and described and are pointed out in the annexed claims, this is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. Various features and aspects of the disclosed embodiments can be combined with or substituted for one another to form varying modes of the disclosed inventions. Thus, it is intended that the scope of at least some of the present inventions herein disclosed should not be limited by the disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any embodiment, feature, or combination of features shown herein. This is true even if only a single embodiment of the feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed considering the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications. and equivalents that come within the spirit of the disclosures described heretofore and or/defined by the following claims are desired to be protected.

What is claimed is:

1. A special 21-point electronic score device (30) for corn hole games made of durable materials and comprised of:

(a) a top section (80) which supports a scoring board (40) with a series of at least twenty-one lights (60) configured along each side, and a series of push-buttons (50,51,52.55) configured along a top and bottom of the top section (80), said top section (80) having a compartment (90) which contains a set of batteries (100) to power and energize the lights when the push-buttons are operated and said top section having a handle (70) to carry the device (30) said scoring board further comprised of an advertising area (41);

(b) a telephone recess compartment (89) and a telephone support pan (182) comprised above the top section (80);

(c) a leg/support section (120);

(d) a means to pivotally secure the top section (80) to the leg/support section (120);

(e) a stabilizing base (130) with an angle brace (133) to fixedly connect the stabilizing base (130) to the leg/support section (120);

(f) a means to pivotally connect the stabilizing base (130) to the leg section/support structure (120)

wherein the top section (80), leg/support section (120, and stabilizing base (130) when interconnected provide the special 21-point electronic score device (30) which when set-up provides LED lighting that allows the score to be seen from far away and in low light or at night and when folded-up is compact and portable.

2. The special 21-point electronic score device (30) of claim 1 wherein the durable material is selected from the group of polymers, metals, and a composite material.

3. The special 21-point electronic score device (30) of claim 2 wherein the polymer material is selected from the group consisting of urethane, polyurethane, Polyethylene Terephthalate (PETE or PET or PETG), High-Density Polyethylene (HDPE), Polyvinyl Chloride (PVC), Low-Density Polyethylene (LDPE), Polypropylene (PP), and Acrylonitrile butadiene styrene (ABS), thermoplastic elastomers (TPE), Acrylonitrile Styrene (ASA); Acrylonitrile Butadiene Styrene (ABS) Plastic; polycarbonate-Acrylonitrile Butadiene Styrene (PC-ABS); polylactic acid (PLA); Polyamide (PA-nylon), and Glass Filled Polyamide (reinforced nylons).

4. The special 21-point electronic score device (30) of claim 2 wherein the metal material is selected from the group of consisting of aluminum, steel, and steel alloys.

5. The special 21-point electronic score device (30) of claim 1 further comprised at least one drink holder (183).

6. The special 21-point electronic score device (30) of claim 1 further comprised of a recharger unit (106).

7. The special 21-point electronic score device (30) of claim 1 wherein the battery (100) is selected from the group consisting of alkaline, small/sealed lead acid, lithium ion (Li-ion), lithium-ion polymer (LIPo), Nickle cadmium (NiCd), and Nickle metal hydride (NiMH) batteries.

8. The special 21-point electronic score device (30) of claim 1 wherein the light (60) is selected from the group consisting of Light Emitting Diode (LED), incandescent bulbs, fluorescent lamps, compact fluorescent lamps (CFL), and halogen lamps.

9. A special 21-point electronic score device (30) for corn hole games made of durable materials and comprised of:

(a) a top section (80) which supports a scoring board (40) with a series of at least twenty-one lights (60) configured along each side, and a series of push-buttons (50,51,52,55) configured along a top and bottom of the top section (80), said top section having a compartment (90) which contains a set of batteries (100) to power and energize the lights when the push-buttons are operated and said top section having a handle (70) to carry the device (30);

(b) the top section (80) further comprised of a top horizontal member (82T) configured with a telephone recess compartment (89) and a telephone support pan (182), a bottom horizontal member (82B), a pair of vertical members (84) consisting of a left member (84L) and right member (84R); a fixedly secure means (86) for connecting top (82T), bottom (82B), left (84L), and right (84R) members to configure the top section (80) as a rectangular support of the scoring board (40);

(c) the scoring board (40) further comprised of a means (43) to connect designed scoring board (40) to top section (80), an advertising area (41), an outer surface (450S), and an inner surface (451S) and said "42" lights (60) configured as numbers (42A) alongside for team/individual A and as numbers (42B) alongside for each team/individual B, and a means (43) to connect designed scoring board (40) to top section (80);

(d) a leg/support section (120) further comprised of a pair of vertical and generally upward legs (121) (left and right (121L) and (121R), a recess (122) in leg section/support structure (120 to accept configuration (134) at end of angle brace (133), and a reinforced webbing (125) interior to the legs (121L) and (121R) as strengthening;

(e) a means (132) to pivotally secure the top section (80) to the leg/support section (120) which consists of an aperture/recess (87) at lower end of members (84R,L) to accept a pivot/pin/hinge (128);

(f) a stabilizing base (130) with an angle brace (133) to fixedly connect and end configuration (134) of said angle brace (133) of the stabilizing base (130) to the leg/support section (120) at a recess (122);

(g) a means (135) to pivotally connect the stabilizing base (130) to the leg section/support structure (120)

wherein the top section (80), leg/support section (120), and stabilizing base (130) when interconnected provide the special 21-point electronic score device (30) which when set-up provides LED lighting that allows the score to be seen from far away and in low light or at night and when folded-up is compact and portable and wherein the 21-point electronic score device (30) can be used with at least one type of game.

10. The special 21-point electronic score device (30) of claim 9 wherein the durable material is selected from the group of polymers, metals, and a composite material.

11. The special 21-point electronic score device (30) of claim 10 wherein the polymer material is selected from the group consisting of urethane, polyurethane, Polyethylene Terephthalate (PETE or PET PETG), High-Density Polyethylene (HDPE), Polyvinyl Chloride (PVC), Low-Density Polyethylene (LDPE), Polypropylene (PP), and Acrylonitrile butadiene styrene (ABS), thermoplastic elastomers (TPE), Acrylonitrile Styrene (ASA); Acrylonitrile Butadiene Styrene (ABS) Plastic; polycarbonate-Acrylonitrile Butadiene Styrene (PC-ABS); polylactic acid (PLA); Polyamide (PA-nylon), and Glass Filled Polyamide (reinforced nylons).

12. The special 21-point electronic score device (30) of claim 10 wherein the metal material is selected from the group of consisting of aluminum, steel, and steel alloys.

13. The special 21-point electronic score device (30) of claim 9 further comprised at least one drink holder (183).

14. The special 21-point electronic score device (30) of claim 9 further comprised of a recharger unit (106).

15. The special 21-point electronic score device (30) of claim 9 wherein the battery (100) is selected from the group consisting of alkaline, small/sealed lead acid, lithium ion (Li-ion), lithium-ion polymer (LIPo), Nickle cadmium (NiCd), and Nickle metal hydride (NiMH) batteries.

16. The special 21-point electronic score device (30) of claim 9 wherein the light (60) is selected from the group consisting of Light Emitting Diode (LED), incandescent bulbs, fluorescent lamps, compact fluorescent lamps (CFL), and halogen lamps.

17. The special 21-point electronic score device (30) of claim 9 wherein the fixedly secure means (86) for connecting top (82T), bottom (82B), left (84L), and right (84R) members to configure the top section (80) as a rectangular support of the scoring board (40) is selected from the group consisting of threaded fasteners rivets, and an adhesive.

18. The special 21-point electronic score device (30) of claim 9 wherein the at least one type of game is selected from the group consisting of Corn Hole, Horseshoes, Table Tennis, Volleyball, Shuffleboard, and Badminton.

* * * * *